United States Patent [19]

Keutgen et al.

[11] Patent Number: 4,714,105

[45] Date of Patent: Dec. 22, 1987

[54] MACHINE FOR CONTINUOUS, MULTISTRAND CASTING IN THE HORIZONTAL

[75] Inventors: Franz Keutgen, Lissendorf; Achim Kubon, Neukirchen-Vluyn; Dieter Perings, Buedesheim; Peter Stadler, Siegen; Peter Voss-Spilker, Kempen; Karl-Hermann Apel, Siegen, all of Fed. Rep. of Germany

[73] Assignee: Mannesmann AG, Duesseldorf, Fed. Rep. of Germany

[21] Appl. No.: 34,897

[22] Filed: Apr. 6, 1987

[30] Foreign Application Priority Data

Apr. 4, 1986 [DE] Fed. Rep. of Germany ..... 3611287

[51] Int. Cl.[4] ..... B22D 11/08

[52] U.S. Cl. ..... 164/420; 164/440

[58] Field of Search ..... 164/420, 440

[56] References Cited

U.S. PATENT DOCUMENTS 4,195,685 4/1980 Sladkoshteev et al. ..... 164/420

4,653,570 3/1987 Stonecliffe et al. ..... 164/440

*Primary Examiner*—Nicholas P. Godici

*Assistant Examiner*—Richard K. Seidel

*Attorney, Agent, or Firm*—Ralf H. Siegemund

[57] ABSTRACT

For multiple strand casting in the horizontal, a distributor vessel and several molds connected thereto, are arranged on a carriage being movable in direction of multiple parallel casting lines, and a plurality of stationary mounts are provided to be connected to bar-like lateral extensions of the molds by means of hydraulically operated plungers.

6 Claims, 4 Drawing Figures

(A-A)

MACHINE FOR CONTINUOUS, MULTISTRAND CASTING IN THE HORIZONTAL

BACKGROUND OF THE INVENTION

The present invention relates to continuous casting in the horizontal, particularly for a plurality of ingots, using equipment which includes a distributing or feeder vessel, as well as a plurality of molds being provided to be respectively oriented with particular accuracy on multiple parallel casting axis.

A machine for continuous casting in the horizontal generally, and of the type referred to above, is known, for example, through German printed and published patent application No. 34 11 769; (see also U.S. patent application Ser. No. 716,148, filed Mar. 26, 1985). This known device includes a connection between the storage and feeding vessel, on one hand, and the mold proper, on the other hand. This connection is adjustable in relation to the casting axis as far as orienting the feeding in relation to the casting and ingot withdrawal is concerned. The storage and feeding vessel is provided with a refractory aperture member and nozzle member, likewise of refractory material, is inserted in that aperture. The connection of the mold provides for the adjustability and sealingly engages the front of the nozzle member.

During continuous casting and, occasionally, after a completed run, and prior to the next charge and casting, the mold must be separated from the feeder and storage vessel in order to renew, for example, the connecting and release ring of the mold, or to inspect its condition and state. Depending upon the construction and number of parallely running casting lines, this particular step will have to be carried out either on-line directly and in a literal sense, or removal from the line of casting is required. Assembly and preparation of the mold for continuous casting outside of the line of casting, however, entails that the unit being comprised of the feeding vessel and of horizontal casting mold, will be placed into operating state and conditon just immediately prior to casting proper. Here then the problem arises of orienting the mold exactly into the line and direction of casting, and to make sure that the mold maintains that position. In case of multiple strand and ingot casting, however, this problem has not yet been solved satisfactorily. This dis-assembly and subsequent re-assembly of the molds entails a considerable loss in time, particularly then, for reasons of space or because only limited number of adequately trained personnel is available, not all of these molds and lines can be worked on simultanuously.

The quality of the product resulting from horizontal casting requires during casting very exact relative motions between the mold, on one hand, and the casting and ingot, on the other hand. Generally, during horizontal casting the ingot is cyclically moved, whereby particularly a forward or extracting motion is followed by a brief retraction following which a certain holding period is interposed. During a forward or extraction movement a portion of shell or skin is formed anew, and will, or has to be, welded to that shell or skin portion that was produced in that manner during the preceding forward and extractiong motions. The holding period serves to ensure intimite welding of sequentially produced casting shells to each other with the requisite degree of certainty for that welding process to obtain a true continuous process. For this cyclic operation to work, the mold must not change position because only then will it be possible that the brief retraction reaches with certainty back into the mold again. It has been found in practice, however, that some relative motion among the equipment pieces almost seems to be inevitable. Moreover, these motions of the mold or molds seem to be more or less uncontrollable. This, however, interferes negatively with the quality of the product.

In the case of single line casting, the mold is placed on the casting line and anchored to be adequately immobilized. The feeding vessel is then moved towards the mold and connected therewith. This relatively simple operation, including adjustment, is, however, not possible in case of multiple strand and ingot casting, simply because certain thermal workings and play, particularly in the system which guides and controls the flow of the molten material, precludes adjustment with the requisite degree of accuracy. Just fastening the molds to the distributing vessel is, therefore, simply not possible, because accurately positioning has not yet been attained.

DESCRIPTION OF THE INVENTION

It is an object of the present invention to provide a new and improved equipment for positioning and orienting multiple molds for concurring and parallel continuous casting in an accurate relation to the horizontal parallel lines of casting and withdrawal.

In accordance with the preferred embodiment of the present invention, it is suggested to provide a carriage, and to arrange the distributor and feeding vessel, as well as one horizontal casting mold per casting line, on that carriage in conjunction with a slide lock and closure for each mold; when the carriage is in operating position each of the individual molds can be connected to stationary mounts under utilization of appropriate locking and position fixing structure. The distributing vessel and the molds will be prepared in a work station, and appropriately positioned on that carriage. In that work station they are particularly oriented and adjusted in relation to the distributing and feeding vessel, and mounted thereto. In addition, the slide lock is also arranged on the carriage. Now, the entire unit as mounted on the carriage is moved by the carriage into the lines of continuous casting and the molds as so positioned are now being anchored to the mounts whereby particularly the fastening and locking structures position and orient the molds into the requisite position and orientation vis-a-vis the mounts. It was found that this inventive adjusting system requires considerably less than a quarter of an hour for installation, which favorably compares with known adjusting methods, requiring at least half an hour, in cases even several hours.

In furtherance of the invention, it is suggested to provide the individual molds with lateral barlike extensions by means of which the molds are connected to the mounts using plug-like connections such as hydraulically operated plungers. If any portion of the equipment has become distorted on account of heating or the like, it will be forced by operation of these plug connections into the desired position and orientation. It is further of advantage to provide these mounts as laterally diametrically opposed bars so that a bar of one mold faces a bar on the mold next to it. Analogously the mounts are provided in pairs to now obtain symmetrically effective forces, which is beneficial for adjusting the respective structure with certainty. The adjusting procedure can preferably be automated operating the plug connections being comprised of hydraulically operated plungers. These plungers should preferably be arranged on a transverse, yoke-like element.

In addition to the aforementioned adjusting, other manual working steps for preparing the equipment can be simplified. For this, it is suggested to provide for all horizontal molds a cooling water system clamping plate. Further, facilitations in the preparation of the machine for casting includes the provision of start up heads which are also mounted on the carriage and sealed against the molds.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof, will be better understood from the following description taken in connection with the accompanying drawings in which:

Proceeding now to the detailed description of the drawings, FIG. 1 illustrates a machine and device for continuous casting in the horizontal, whereby particularly several (e.g. four) casting strands or ingots are to be produced simultaneously. A metal (e.g.) distributing and feeding vessel 2 is associated with four molds 7, 8, 9, and 10, respectively, for the casting of casting 3, 4, 5, and 6. All these parts are arranged on a carriage 11. This carriage 11 can be moved into the particular operating position, shown in FIGS. 1 and 2, from a work station, which is situated elsewhere and is not shown. The distributing and feeding vessel 2, as well as the molds 7 through 10, were mounted on the carriage 11, for example, in that work station, and they have also been subsequently pre-heated. In addition, slide locks 13 are provided for each of the casting lines, and they were also mounted to the equipment in that work station.

Figure 1:
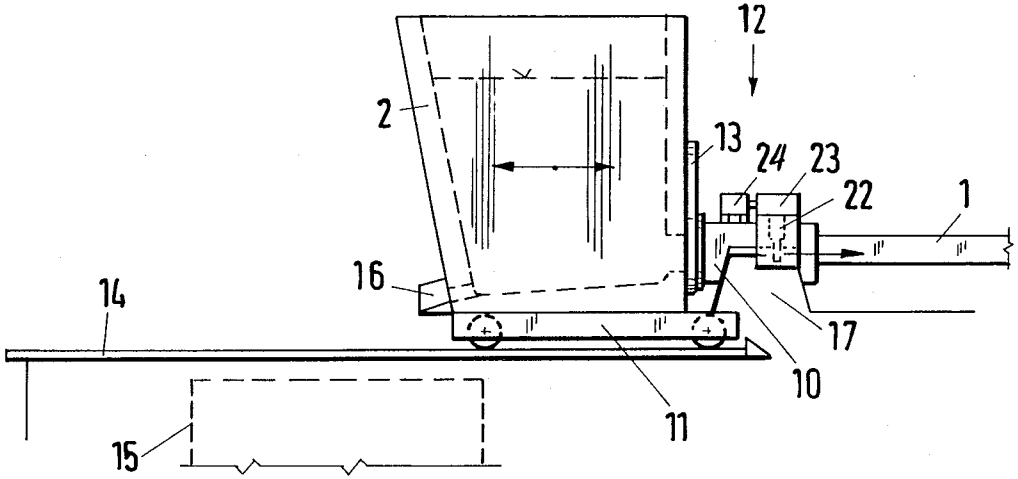
FIG. 1 is a side view of a machine for continuous casting in the horizontal showing the operating state and position for that machine.
Figure 2:
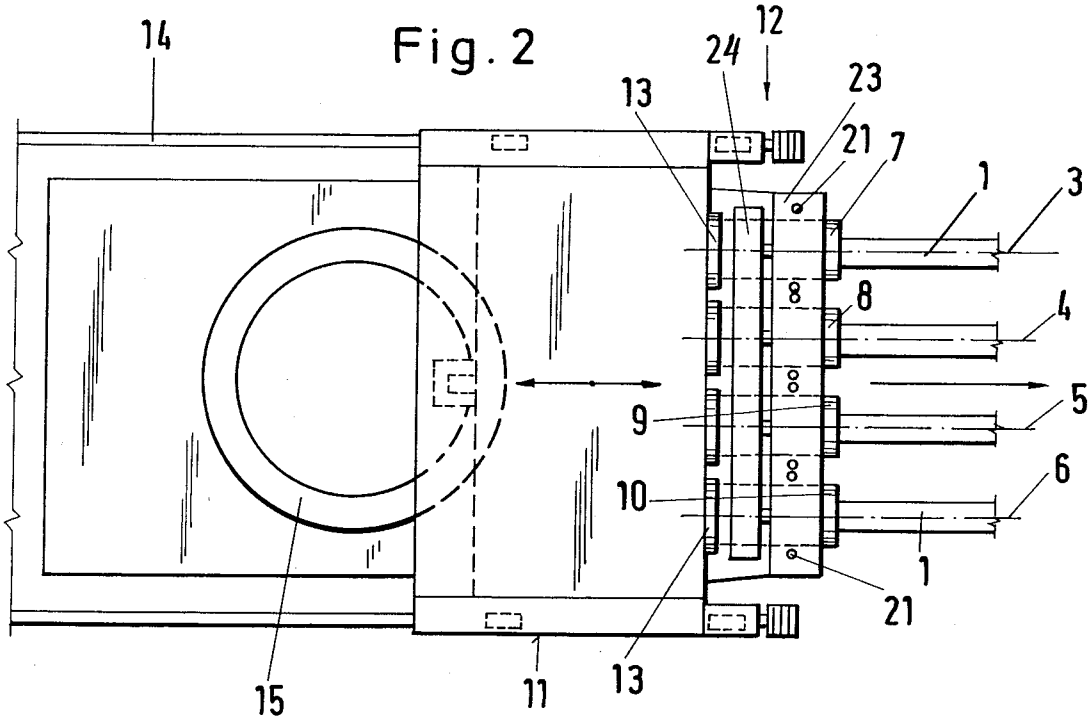
FIG. 2 is a top view of the machine shown in FIG. 1.

The casting stand proper is provided with rails 14 on which the carriage 11 rolls to attain operating position. Basically it is immaterial from which direction the carriage is rolled into casting position. However, for practical reasons at least the last end of that track should be parallel to the lines of casting for on-and-in-line positioning of the molds. A pit with an emergency ladle 15 may be provided underneath the rails 14. The distributing vessel 2 is, on its rear side, provided with a discharge opening 16 which is opened only in case of an emergency but can also be used for the discharge of any residual metal from the distributing and feeding vessel 2, as well as for the discharge of any slag.

Depending upon the length of the molds 7 through 10, and corresponding to that distance, mounts 17 are provided and stationarily positioned. They identify, in effect, the operating position 12 for the carriage and molds and the distributing vessel thereon. Each of the molds 7 through 10 is provided with diametrically opposed horizontally, radially outwardly extending bars 18 and 19. These bars or bar-like extensions are connected through locking elements 20 with the mounts 17. The locking structures 20 each are particularly comprised of a plug connection 21 which is mounted on a lifting plunger 22 being hydraulically operated.

Figure 3:
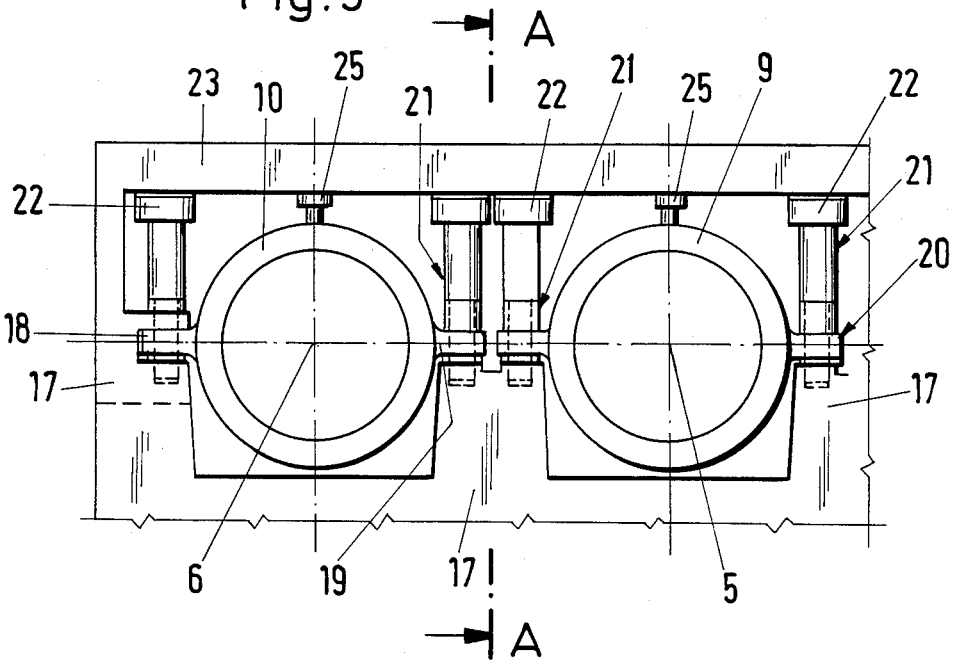
FIG. 3 illustrates a front view of a detail of the machine shown in FIGS. 1 and 2, the detail being shown in an enlarged scale, and showing particularly two of the four casting lines.

As shown specifically in FIG. 3, the mounts 17 are arranged in pairs that such a pair is, respectively, associated with two adjoining molds along facing sides thereof and corresponding specifically to two bars which face each other; one being a bar-like extension 18 on one mold and the other being a bar-like extension 19 of the respective other mold. All locking structures and elements, particularly hydraulics from the plungers 22 of the plug connections 21, are mounted to a transverse yoke 23.

Figure 4:
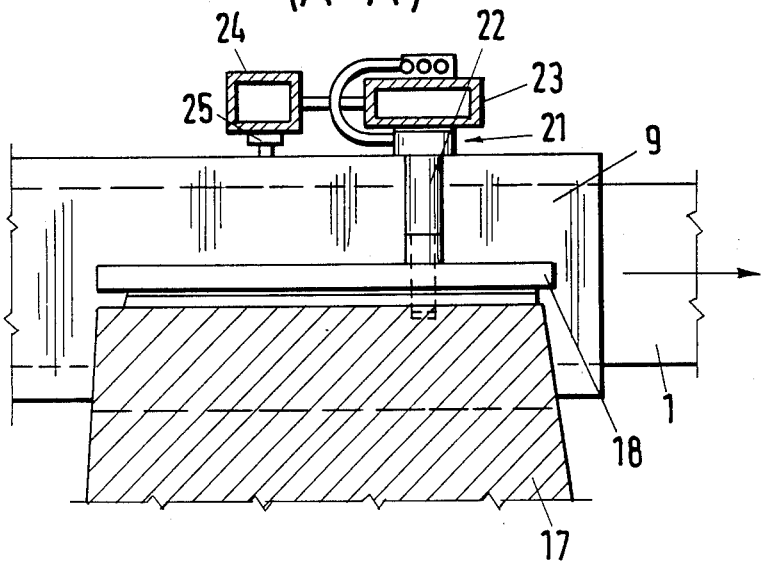
FIG. 4 is a cross-section, as indicated by A-A in FIG. 3.

In addition, a cooling water clamping plate 24 is provided on that yoke and transverse structure 23, and as shown specifically in FIG. 4. This clamping plate 25 holds the elements necessary for connecting the molds to a cooling system. These connections include the inlets, outlets and conduits 25 for all of the molds in order to cool them appropriately. Upon mounting the clamping plate 24 with the charge or discharge conduits 25 onto the molds and their water and outlets, one not only provides therewith the appropriate and requisite connection, but also from the requisite sealing thereof.

In addition to the locking structures 20 for the extensions 18 and 19, the carriage 11 may be independently locked and latched into its operating position. For example, this carriage locking may be molded as a compensation for any local gravity forces that arise. The rails 14 may not necessarily run exactly horizontal, so that a force vector is set up in one direction or the other, along the rails. The locking of the carriage makes sure that this force does not become effective.

The extensions 18 and 19, as illustrated in FIGS. 1, 3, and 4, are shown specifically to be spaced from the mount 17 by means of an air gap. In other words, normally they do not directly sit on these mounts. An exact matching of the position is possible, and ultimately then, intermediate shims may be interposed for purposes of adjustment and trimming. Some sizing may be required here.

The invention is not limited to the embodiments described above, but all changes and modifications thereof, not constituting departures from the spirit and scope of the invention, are intended to be included.

We claim:

1. In a machine for continuous casting of multiple casting strands and ingots in the horizontal, which machine includes a distributor and feeding vessel, and a plurality of horizontal casting molds, a structure for placing and positioning as well as orienting the molds in alignment with a respective plurality of continuous casting lines, comprising:

a carriage on which said distributing vessel as well as said molds are mounted in conjunction with respective slide locks, said carriage being movable in relation to said lines of casting including movement along said lines of casting;

a plurality of stationary mounts, having particular invariable positions in relation to said lines of casting; and locking means for connecting said molds on the carriage, to said mounts whenever said carriage has a particular position in relation to said mounts.

2. In a machine as in claim 1, wherein each of said molds is provided with laterally, diametrically, opposedly extending bar-like extensions, there being plug mounts for connecting said extensions to said mounts to obtain said connection of the molds to said mounts.

3. In a machine as in claim 2, wherein several of said bar-like extensions face each other, some of said mounts being correspondingly arranged in pairs.

4. In a machine as in claim 2, wherein said plug connections include hydraulically operated lifting plungers.

5. In a machine as in claim 4, said lifting plungers being provided on a common transverse yoke element.

6. In a machine as in claim 1, including a common clamping plate for cool water conduits.

* * * * *